United States Patent [19]

Thoma

[11] Patent Number: 5,067,398

[45] Date of Patent: Nov. 26, 1991

[54] CAN CRUSHER

[76] Inventor: Norman E. Thoma, 112 Longmount Dr., Pittsburgh, Pa. 15214

[21] Appl. No.: 405,287

[22] Filed: Sep. 11, 1989

[51] Int. Cl.[5] ..... B30B 15/14; B30B 1/18

[52] U.S. Cl. ..... 100/53; 100/256; 100/264; 100/289; 100/902

[58] Field of Search ..... 100/902, 264, 244, 256, 100/289, 52, 53

[56] References Cited

U.S. PATENT DOCUMENTS

| | | | |
|---|---|---|---|
| 68,568 | 9/1867 | McElroy | 100/264 |
| 92,201 | 7/1869 | McCullough et al. | 100/264 |
| 437,120 | 9/1890 | Kile | 100/244 X |
| 1,887,226 | 11/1932 | Wunderlich | 100/264 X |
| 2,773,536 | 12/1956 | Lange | 100/264 |
| 3,768,398 | 10/1973 | Ullman, Jr. | 100/244 X |

FOREIGN PATENT DOCUMENTS

| | | | |
|---|---|---|---|
| 57-79100 | 5/1982 | Japan | 100/902 X |
| 58-132400 | 8/1983 | Japan | 100/902 X |

*Primary Examiner*—Timothy F. Simone
*Assistant Examiner*—Stephen F. Gerrity
*Attorney, Agent, or Firm*—William J. Ruano

[57] ABSTRACT

A can crusher comprising a container, a reversible motor mounted therein, a pinion gear driven by said motor and a gear driven by said motor and a gear of greater diameter driven by said pinion gear. A threaded shaft, having right hand threads on one side and left hand threads on the opposite side, is provided as the gear of greater diameter. A pair of can-crushing arms, one geared to the right hand threads and the other geared to the left hand threads, effects crushing of a can therebetween. A reversing switch is operated by one of the can-crushing arms after predetermined movement in the crushing direction to drive the arms apart.

2 Claims, 2 Drawing Sheets

CAN CRUSHER

This invention relates to a can crusher, particularly for cans for soft drinks and beer.

BACKGROUND OF THE INVENTION

An object of the present invention is to overcome the above-named disadvantages by providing a compact and inexpensive can crushing apparatus that is easy to operate, very compact and inexpensive.

BRIEF DESCRIPTION OF THE DRAWING

Referring more particularly to the drawing.

DESCRIPTION OF THE PREFERRED EMBODIMENT

Figure 1:
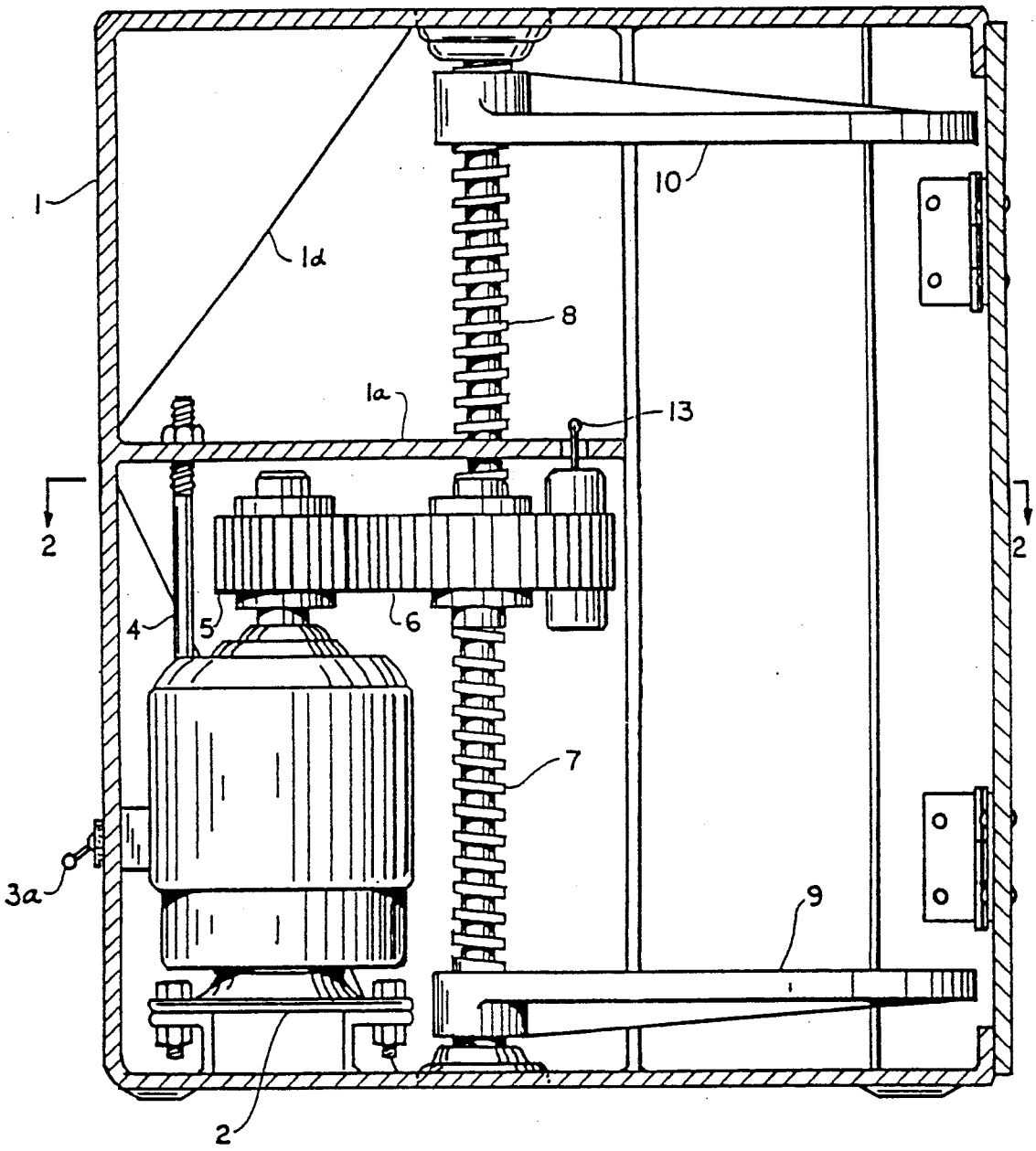
FIG. 1 is an elevational cross-sectional view of a can crusher embodying the present invention.
Figure 2:
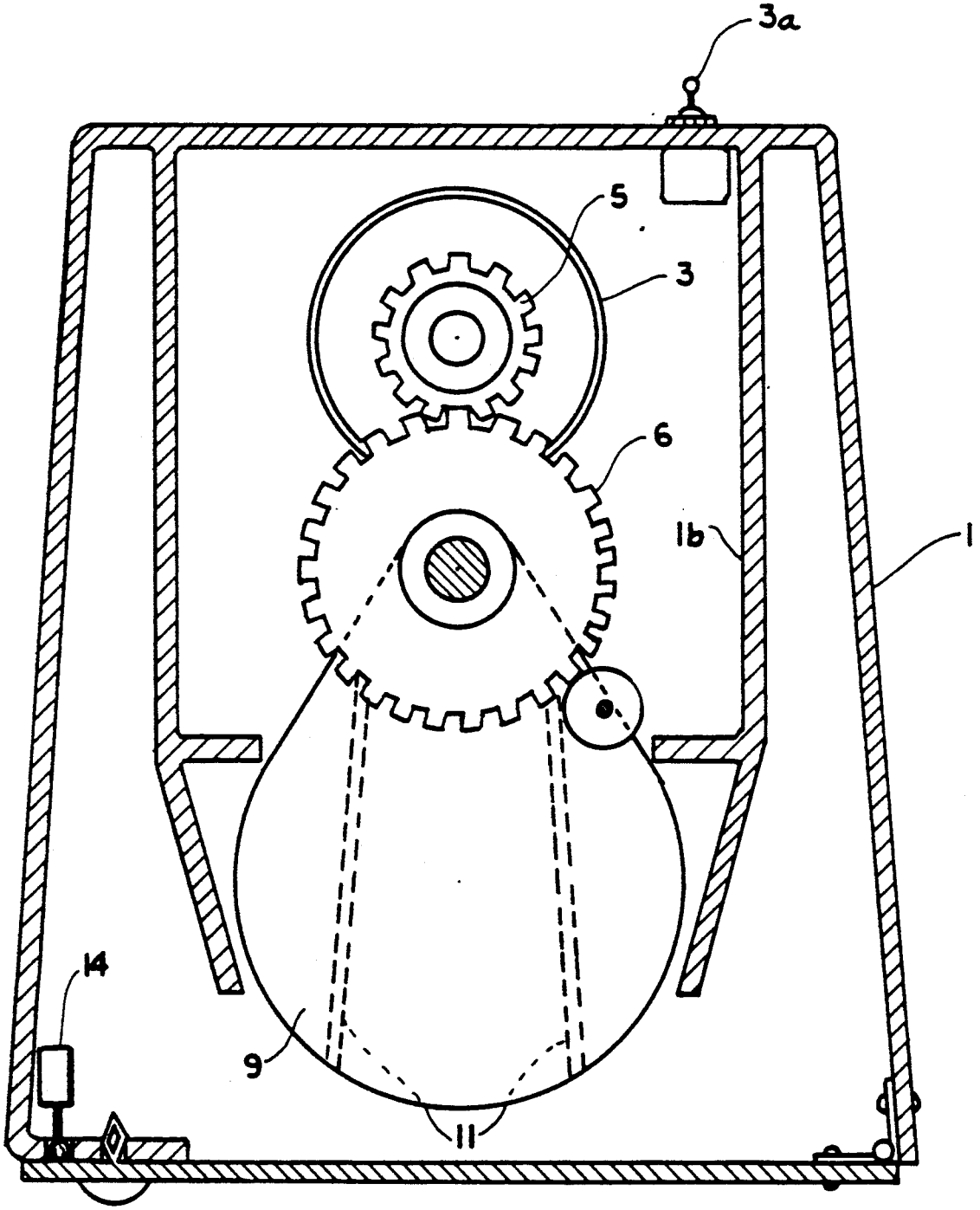
FIG. 2 is a horizontal cross-sectional view taken along line 2—2 of FIG. 1.

Referring to FIGS. 1 and 2, numeral 1 denotes a container or casing of metal, although it may be of plastic, instead having a horizontal interior wall 1*a*, a door 1*b* hinged on hinges 1*c* and having reinforcing gussets 1*b*. A base 2 is provided in the container for supporting an electric motor 3 controlled by an electric switch 3*a*, which motor is further supported by horizontal wall 1*a* through a bolt 4.

Motor 3 drives a pinion gear 5 which, in turn, drives gear 6 of larger diameter, which in turn drives threads 7 and 8 which are, respectively, right and left threads, (or vice versa), which threads are threaded to corresponding internal threads of arms 9 and 10 which are flanged, for reinforcement and serve the purpose of crushing a can mounted therebetween.

In operation, when switch 3*a* is turned on while the can is in place between arms 9 and 10, such arms will move forceably towards each other to effect crushing of the can. When the upper arm 10 moves downwardly sufficiently to operate return or reversing switch 13, the motor will reverse and drive threads 7 and 8 in an opposite direction so as to cause arms 9 and 10 to move apart to the position shown in FIG. 1. Safety switch 14 opens the circuit on opening the door.

Thus it will be seen that I have provided a compact and highly efficient can crushing unit which may be made even more compact by eliminating the entire portion of the casing to the right of horizontal wall 1*a*, in which case the wall will be open on the right hand side.

While I have illustrated and described several embodiments of my invention, it will be understood that these are by way of illustration only and that various changes and modifications are contemplated in my invention within the scope of the following claims:

I claim:

1. A can crusher comprising a vertically extending container having a side door, a top wall, a bottom wall, and an intermediate horizontal wall extending within said container, a reversible motor vertically mounted within said container and supported below said horizontally extending wall, an "on-off" switch connected to said reversible motor and mounted on an exterior surface of said container, a pinion gear within said container and driven by said reversible motor, a second gear within said container and driven by said pinion gear, a vertically extending threaded shaft extending through said second gear and said horizontal wall and rotatably driven by said second gear and rotatably mounted to the top and bottom of said container and having right hand threads and left hand threads on opposing sides of said second gear and horizontally extending wall, a first and second horizontally extending can-crushing arms, threaded, one to said right hand threads and one to said left hand threads, said arms moving a predetermined distance toward one another from a first position to a second position to effect the crushing of a can placed therebetween, and a reversing switch connected to said reversible motor and extending through said intermediate horizontal wall and actuated by one of said can-crushing arms after moving said predetermined distance to said second position to effect reversal of said motor to thereby move said can-crushing arms from said second position to said first position.

2. The can crusher as recited in claim 1 further comprising safety switch mounted on said door for preventing operation of said reversible motor as a result of said door being opened.

* * * * *